United States Patent [19]

Acquaviva

[11] Patent Number: 4,716,439

[45] Date of Patent: Dec. 29, 1987

[54] HALF-MODE COPYING MACHINE

[75] Inventor: Thomas Acquaviva, Penfield, N.Y.

[73] Assignee: Xerox Corporation, Stamford, Conn.

[21] Appl. No.: 854,214

[22] Filed: Apr. 21, 1986

[51] Int. Cl.[4] ..... G03G 15/04

[52] U.S. Cl. ..... 355/7; 355/3 R; 355/8; 355/14 E; 355/25

[58] Field of Search ..... 355/7, 8, 14 E, 14 R, 355/25, 3 R

[56] References Cited

U.S. PATENT DOCUMENTS

| | | | |
|---|---|---|---|
| 3,712,729 | 1/1973 | O'Brien | 355/25 |
| 4,017,173 | 4/1977 | Komari et al. | 355/8 |
| 4,045,218 | 8/1977 | McVeigh | 355/4 X |
| 4,088,401 | 5/1978 | Rees et al. | 353/122 |
| 4,256,400 | 4/1977 | Komori et al. | 355/8 |
| 4,618,244 | 10/1986 | Watanabe | 355/14 R X |
| 4,659,207 | 4/1987 | Maekawa | 355/7 |

FOREIGN PATENT DOCUMENTS

| | | |
|---|---|---|
| 402288 | 2/1943 | Italy . |
| 54-149642 | 11/1979 | Japan . |
| 56-161559 | 11/1981 | Japan . |
| 59-13231 | 1/1984 | Japan . |

OTHER PUBLICATIONS

Xerox Disclosure Journal, vol. 8, No. 2, p. 121; author Strella, publ. Mar./Apr. 1983; title "Method for Copying II Inch by 17 Inch Original Documents".

*Primary Examiner*—A. T. Grimley
*Assistant Examiner*—Jane K. Lau
*Attorney, Agent, or Firm*—H. Fleischer; J. E. Beck; R. Zibelli

[57] ABSTRACT

An electrophotographic printing machine in which two original documents are supported on the platen of an exposure station. Both original documents are flash illuminated to record an electrostatic latent image on a photoconductive surface. One-half of the electrostatic latent image is erased. In this way, one of the original documents is reproduced on a copy sheet. During the next successive machine cycle, a second electrostatic latent image corresponding to both original documents is recorded on the photoconductive member. The other half of the electrostatic latent image is erased and a copy formed corresponding to the other original document.

7 Claims, 3 Drawing Figures

HALF-MODE COPYING MACHINE

This invention relates generally to an electrophotographic printing machine, and more particularly concerns an optical system wherein successive halves of a document are reproduced on different copy sheet surfaces.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive member, the latent image is developed by bringing a developer mixture into contact therewith. This forms a powder image on the photoconductive member which is subsequently transferred to a copy sheet. Finally, the powder image is heated to permanently affix to the copy sheet in image configuration.

In high-speed, electrophotographic printing machines, successive original documents are positioned on the platen and flash illuminated. Frequently, it is desirable to copy two original documents positioned on the platen on different copy sheet surfaces. For example, a book or magazine may be opened and the opposite pages thereof positioned on the platen for reproduction. It is desirable to be capable of reproducing each page of the book on different copy sheet surfaces. Thus, the machine operator may reproduce each page of the book on opposite sides of the same copy sheet or on different copy sheets. In order to accomplish this with a flash illumination system, it has been found to be extremely complex and difficult. Hereinbelow, split scannng systems have been employed to achieve the foregoing. The following disclosures appear to be relevant:

U.S. Pat. No. 3,712,729; Patentee: O'Brien; Issued: Jan. 23, 1973.

U.S. Pat. No. 4,017,173; Patentee: Komari et al.; Issued: Apr. 12, 1977.

U.S. Pat. No. 4,088,401; Patentee: Rees et al.; Issued; May 9, 1978.

Japanese Patent Publication No. 56-161559; Applicant: Kitabayashi; Publication Date: Nov. 12, 1981.

Japanese Patent Publication No. 54-149642; Applicant: Idenawa; Publication Date: Nov. 24, 1979.

Japanese Patent Publication No. 59-13231; Applicant: Shibata; Publication Date: Jan. 24, 1984.

Italian Patent No. 402,288; Issue Date: Feb. 26, 1943.

Xerox Disclosure Journal, Vol. 8, No. 2, Page 121; Author: Strella; Published: March/April 1983.

The relevant portions of the foregoing disclosures may be briefly summarized as follows:

O'Brien discloses a document reproduction apparatus employing a prism having a first and second surface positioned in contact with the pages of a book to enable a camera to take a photograph thereof.

In Komari et al., an open book is positioned on the platen of the copying machine. The optical system is a scanning system wherein the light source, lens and mirrors move across the platen to illuminate successive incrementals of the document positioned on the platen. A control system controls the movement of the optical system such that it moves across one-half of the book to record an electrostatic latent image on the photoconductive surface corresponding to one page thereof. Thereafter, the optical system moves across the other half of the book to record and electrostatic latent image corresponding to the other page of the book on the photoconductive surface. These electrostatic latent images are developed and transferred to different copy sheet surfaces. The copy sheet surfaces may be on opposite sides of the same copy sheet or on different copy sheets.

In Rees et al., a pair of lens and an optical shutter cooperate with one another and a mask associated with the platen to form twin images of one-half of an original document or only one of two documents positioned on the platen. In this way, two light images corresponding to one of two documents on the platen are formed.

Kitabayashi discloses two photoconductive drums each arranged to have one page of a book recorded thereon.

Idenawa describes an original dividing copier wherein a portion of an original document may be copied by shifting the position of the original document to the required coordinates.

Shibata describes an optical scanning system which scans a first half of a document positioned on the platen during the first scan to copy it. Thereafter, the optical scan system returns to the starting position and scans the remaining half of the document. In this way, each half of the document is copied on a different copy sheet.

The Italian Patent discloses a system for copying two sides of a book by rotating an image receiving means from one page to the other page of a book.

Strella discloses an electrophotographic printing machine using a flash illumination system. A control system regulates the flash illumination system such that a document being advanced across the platen by a document handling unit is flash exposed once when the first half of the original document is positioned on the platen and flash exposed a second time when the second half of the original document is located on the platen.

In accordance with one aspect of the present invention, there is is provided an optical system including means for supporting an object. An image station is provided. Means record an image of the object supported by the supporting means on a region of the image station. Means erase a portion of the image of the object on the image station.

Pursuant to another aspect of the present invention, there is provided an electrophotographic printing machine having means for supporting an object therein. A photoconductive member is provided. Means record an electrostatic latent image of the object supported by the supporting means on a region of the photoconductive member. Means erase a portion of the electrostatic image recorded on the photoconductive member.

Other features of the present invention will become apparent as the following description proceeds and upon references to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
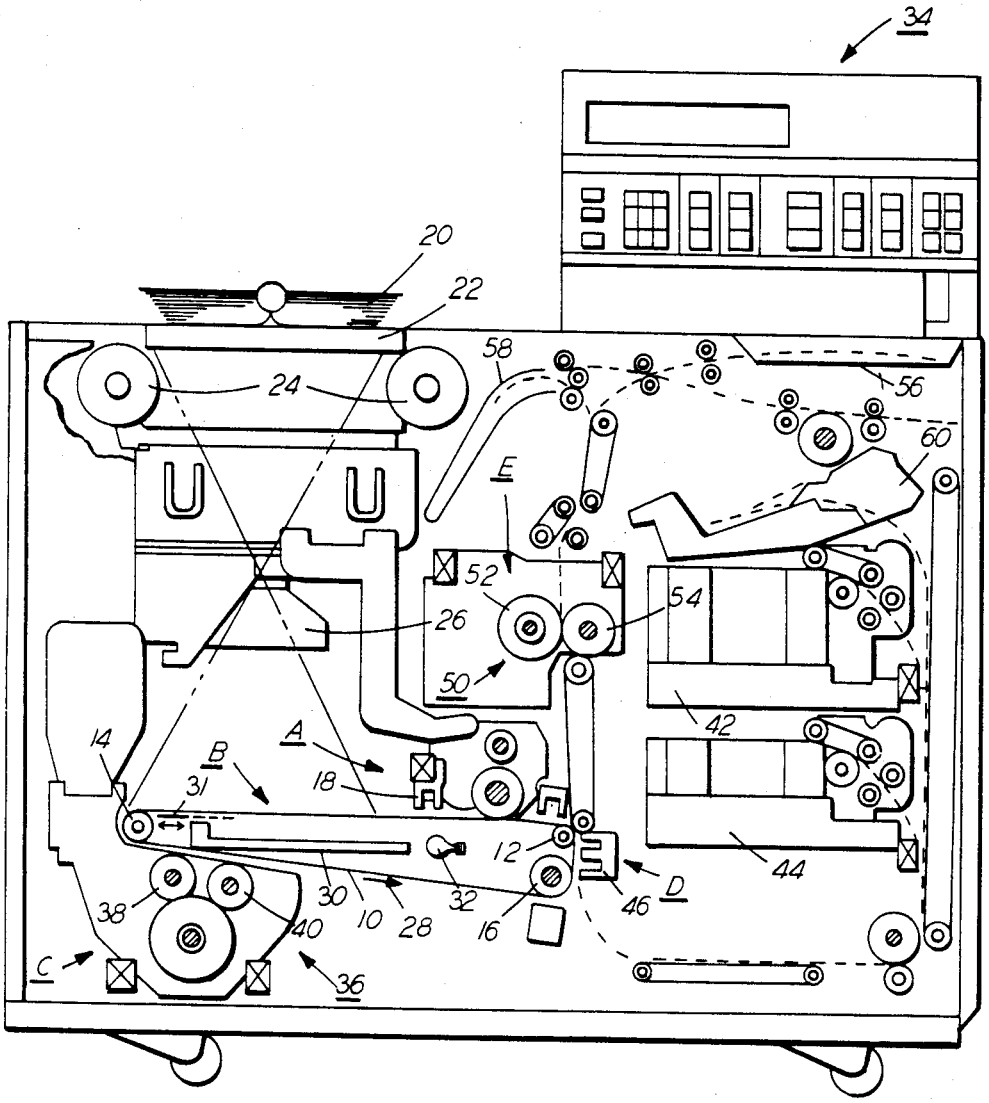
FIG. 1 is a schematic, elevational view of an electrophotographic printing machine incorporating the features of the present invention therein.

For a general understanding of the features of the present invention, reference is made to the drawings. In the drawings, like reference numerals have been used throughout to designate identical elements. FIG. 1 is a perspective view illustrating an electrophotographic printing machine incorporating the features of the present invention therein. It will become apparent from the following discussion that the apparatus of the present invention is equally well suited for use in a wide variety of printing machines and is not necessarily limited in its application to the particular embodiment shown herein.

Referring now to FIG. 1, there is shown an elevational view of an illustrative electrophotographic printing machine incorporating the features of the present invention therein. As shown thereat, the printing machine employs a belt 10 having a photoconductive surface deposited on conductive substrate. Preferably, the photoconductive surface is made from a charge generator layer having photoconductive particles randomly dispersed in an electrically insulating organic resin. The conductive substrate comprises a charge transport layer having a transparent, electrically inactive polycarbonate resin with one or more diamines dissolved therein. Belt 10 advances successive portions of the photoconductive surface sequentially through the various processing stations disposed about the path of movement thereof. Belt 10 is entrained about stripping roller 12, tensioning roller 14 and drive roller 16. Drive roller 16 is coupled to a suitable motor so as to rotate and advance belt 10.

Initially, a portion of belt 10 passes through charging station A. At charging station A, a corona generating device 18 charges the photoconductive surface of belt 10 to a relatively high, substantially uniform potential.

After the photoconductive surface of belt 10 is charged, the charged portion thereof is advanced through exposure station B. At exposure station B, an original document or any object, such as a book, indicated by the reference numeral 20, is positioned on a generally planar, substantially transparent platen 22. Lamps 24 flash light rays onto book 20. The light rays reflected from book 20 are transmitted through lens 26 forming a light image thereof. The light image formed consists of opposite pages of book 20. Lens 26 focuses the light image of opposite pages of book 20 onto the charged portion of the photoconductive surface to selectively dissipate the charge thereon. This records an electrostatic latent image on the photoconductive surface which corresponds to the informational areas contained within the opposite pages of book 20. In order to reproduce each page of book 20 on a different copy sheet surface, i.e. on opposite sides of the same copy sheet or on different copy sheets, it is necessary to erase the portion of the electrostatic latent image corresponding to one of the pages of book 20. As belt 10 continues to move in the direction of arrow 28, a light pipe 30 directs light rays onto the interior surface of the photoconductive surface of belt 10. Light pipe 30 directs the light rays from light source 32 to the interior surface of the photoconductive surface of belt 10. A shutter 31 is associated with light pipe 30. When the shutter 31 is interposed between the interior surface of the photoconductive surface of belt 10 and the light ray outlet of light pipe 30, the photoconductive surface is not illuminated and electrostatic latent image recorded on the photoconductive surface is not discharged. Thus, the machine operator when desiring to copy opposite pages of a book on different copy sheet surfaces actuates the appropriate button on control panel 34. This causes the shutter to block the light rays from the light pipe as the first half of the electrostatic latent image moves thereacross in the direction of arrow 28. After the midpoint of the electrostatic latent image is located over the light pipe, the shutter is moved so as to no longer block the light rays being emitted from the light pipe. In this way, the backside of the photoconductive surface is illuminated and discharged in the region of the electrostatic latent image corresponding to the other half of the book. Thus, the only electrostatic latent image remaining on the photoconductive surface will correspond to the first half of the electrostatic latent image. The other half being discharged. Thereafter, lamps 24 are energized to flash illuminate the same opposite pages of book 20. Once again, the charged portion of the photoconductive surface of belt 10 is discharged to form the electrostatic latent image. At this time, the shutter is not interposed between the light ray outlet of light pipe 30 until the midpoint of the electrostatic latent image passes thereof. In this way, the portion of the electrostatic latent image previously discharged is not discharged and the portion of the electrostatic latent image previously not discharged is discharged. Thus, two successive electrostatic latent images are formed on the photoconductive surface of belt 10 by successive flash illuminations of the discharged areas thereof and selectively erasing opposite halves of the electrostatic latent image. For example, if the belt is a five pitch belt, i.e. each pitch corresponding to an electrostatic latent image, the first pitch will have an electrostatic latent image corresponding to one page of the book with the next pitch having an electrostatic latent image corresponding to the opposite page of the book. The foregoing will be described in further detail with reference to FIGS. 2 and 3. After the electrostatic latent image is formed on the photoconductive surface, belt 10 advances the electrostatic latent image to development station C.

At development station C, a magnetic brush development system, indicated generally by the reference numeral 36, advances developer material into contact with the electrostatic latent image. Preferably, magnetic brush development system 36 includes two magnetic brush developer rollers 38 and 40. Each roller advances developer material into contact with the latent image. These rollers form a brush of carrier granules and toner particles extending outwardly therefrom. The latent image attracts the toner particles from the carrier granules forming a toner powder image on the photoconductive surface of belt 10.

After the electrostatic latent image is developed, belt 10 advances the toner powder image to transfer station D. At transfer station D, successive sheets of support material are advanced from copy sheet trays 42 or 44. Transfer station D includes a corona generating device 46 which sprays ions onto the backside of the copy sheet. This attracts the toner powder image from the photoconductive surface to the copy sheet. Thus, the toner powder image corresponding to the informational areas contained within one page of book 20 are transferred to a first copy sheet and the toner powder image corresponding to the informational areas of the opposite page of book 20 are transferred to a second copy sheet. After transfer, the copy sheets move onto conveyor 48 which advances the sheets to fusing station E.

Fusing station E, includes a fuser assembly, indicated generally by the reference numeral 50, which permanently affixes the transfer powder image to the respective copy sheets. Preferably, fuser assembly 50 comprises a heated fuser roller 52 and back-up roller 54. The copy sheets pass between the fuser roller and the back-up roller with the toner powder image contacting the fuser roller. In this manner, the toner powder images are permanently affixed to the respective copy sheets. After fusing, the copy sheets are advance to output tray 56. The foregoing describes a simplex copying operation. Alternatively, if it is desired to copy opposite pages of the book on the same copy sheets on opposite surfaces thereof, i.e. duplex copying, the first toner powder image is transferred to one side of the copy sheet at transfer station D. The copy sheet advances through fusing station E where the toner powder image is permanently affixed thereto. Thereafter, the copy sheets enters into inverter 58. From inverter 58 rollers advance the copy sheet to duplex tray 60. The copy sheet is then advanced from duplex tray 60 back to transfer station D with the surface thereof not having the toner powder image thereon being positioned in contact with the next toner powder image on the photoconductive surface of belt 10 at transfer station D. It should be noted that the machine will automatically skip the appropriate numbers of pitches in order to insure the opposite side of the copy sheet is advanced in a timed sequence with the toner powder image to the transfer station D. The copy sheet, with the toner powder image transferred to the opposite side thereof, once again passes through fusing station E and the toner powder image corresponding to the other page of book 20 is permanently affixed thereto. The copy sheet then advances to output tray 56. In this duplex mode of operation, opposite pages of book 20 are copied onto opposite surfaces of the same copy sheet.

Figure 2:
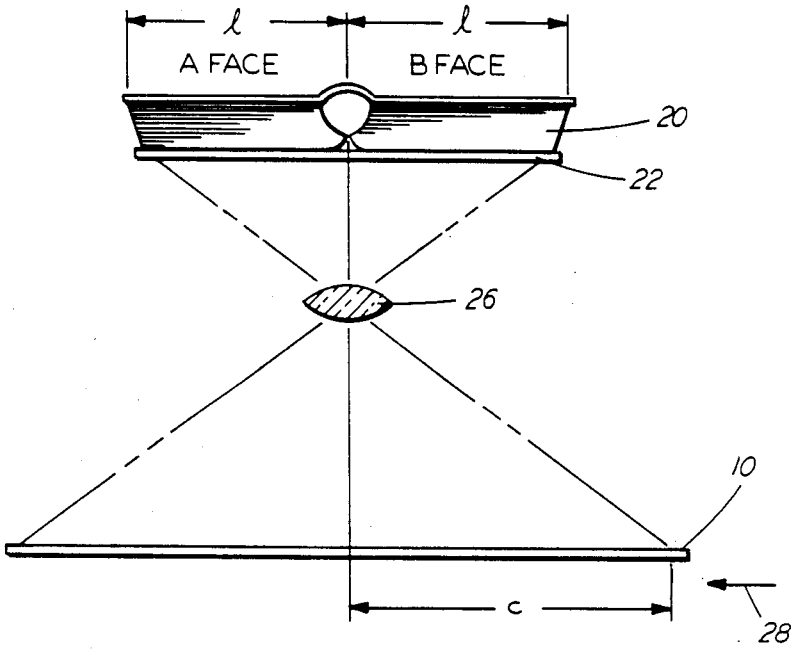
FIG. 2 is a schematic, elevational view showing one page of a book being reproduced in the FIG. 1 electrophotographic printing machine.

Referring now to FIG. 2, further details of the illumination system will be described. As shown thereat, faces A and B of book 20 are flash illuminated and the light rays reflected therefrom transmitted through lens 26 to form a light image and thereof. Lens 26 focus the light image onto the charged portion of the photoconductive surface of belt 10. Belt 10 moves in the direction of arrow 28. The length of faces A and B are equal, e.g.l. As belt 10 moves a distance l, shutter 31 blocks the output of light pipe 30 so that no light rays are emitted therefrom. After belt 10 has moved a distance l, shutter 31 is moved so as to no longer block the light output of light pipe 30. This permits the light rays to illuminate the backside of the photoconductive surface of belt 10. As belt 10 continues to move in the direction of arrow 28, region C thereof is illuminated to discharge the portion of the electrostatic latent image corresponding to face A of book 20. Thus, the portion of the electrostatic latent image remaining on the photoconductive surface of belt 10 corresponds only to face B of book 20. As previously described with reference to FIG. 1, this portion of the electrostatic latent image is developed with toner particles, transferred to the copy sheet, and permanently affixed thereto. Thereafter, faces A and B of book 20 are once again illuminated. This is shown in FIG. 3.

Figure 3:
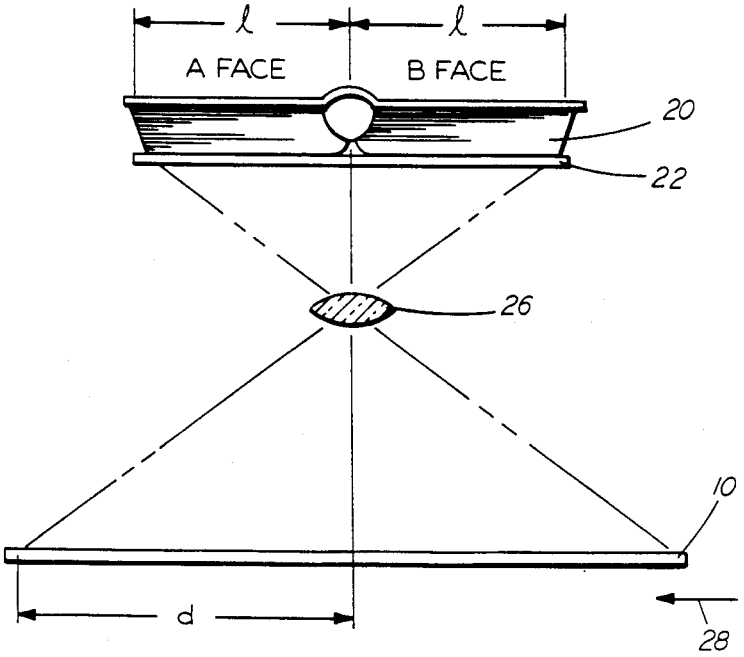
FIG. 3 is a schematic, elevational view showing the other page of the book being reproduced in the FIG. 1 printing machine.

Referring now to FIG. 3, faces A and B of book 20 are once again flash illuminated. The light rays reflected from faces A and B of book 20 are transmitted through lens 26 to form a light image thereof. Lens 26 focuses the light image onto next charged portion, i.e. the next charged pitch, of the photoconductive surface of belt 10. At this time, shutter 31 is positioned remotely from the light outlet of light pipe 30. As belt 10 moves in the direction of arrow 28, light rays emitted from light pipe 30 illuminate the back side of the photoconductive surface of belt 10 in region D. This discharges the half of electrostatic latent image corresponding to face B, the half of the electrostatic latent image corresponding to face B of book 20. After the belt 10 has moved a distance l past the outlet of light pipe 30, shutter is moved to a position wherein it is interposed between the outlet of light pipe 30 and the back side of belt 10. This blocks the light rays being emitted from light pipe 30 from illuminating the backside of the photoconductive surface of belt 10. Thus, the electrostatic latent image corresponding to face A of book 20 is not discharged. The electrostatic latent image corresponding to face A of book 20 is once again developed with toner particles. The toner particles are transferred to a different copy sheet or the opposite side of the same copy sheet having the toner powder image corresponding to face B thereon and permanently affixed thereto. The copy sheet is then advanced to the output tray for removal therefrom by the machine operator.

One skilled in the art will appreciate that selected portions of any object may be reproduced on opposite surfaces of the same copy sheet or on different copy sheets in this manner. The selected portions need not correspond to one half of the object being reproduced. The portions may vary and merely depend upon the timing and duration of time that the shutter is interposed in the light path between the light pipe light ray outlet and the back side of the photoconductive surface of belt 10. Thus, light source 32 in association with light pipe 30 acts as an erase lamp to erase selected portions of successive electrostatic latent images of the same object. In this way, selected portions of the same object may be reproduced on different surfaces of the same copy sheet or on different copy sheets. The foregoing system is particularly well adapted for use with a flash illumination system wherein the entire object is flash illuminated during each illumination cycle. Furthermore, one skilled in the art will also appreciate that a shutter need not be employed but that light source 32 may be energized or de-energized at the appropriate times in lieu thereof. In either case, the control logic of the printing machine in association with the selected mode of operation, as determined by the operator by energizing the appropriate buttons on panel 34, determines whether the resultant copy is two simplex sheets or one duplex sheet.

In recapitulation, the present invention is directed to a flash illumination system wherein the entire object, such as book, is flash illuminated for two successive cycles. This forms two successive electrostatic latent images corresponding to the object. A selected portion of one of the electrostatic latent images is erased. The complimentary portion of the other electrostatic latent image is then erased. These electrostatic latent images, which when combined, form an electrostatic latent image of the entire object, are successively developed with toner particles to form successive toner powder images on the photoconductive surface of the belt. These toner powder images are then transferred to either opposite sides of the same copy sheet, i.e. duplex copying, or to different copy sheets, i.e. simplex copying.

It is, therefore, apparent that there has been provided, in accordance with the present invention, an optical system for recording successive electrostatic latent images which are complementary to one another of the entire object being reproduced. These electrostatic latent images are developed with toner particles to form successive, complimentary toner powder images which are transferred to opposite surfaces of the same copy sheet or different copy sheets. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations that fall within the spirit and broad scope of the appended claims.

I claim:

1. An electrophotographic printing machine, including:

means for supporting a first document and a second document;

a photoconductive member;

means for charging at least a portion of said photoconductive member;

means for flash illuminating the first document and the second document supported by said supporting means;

optical means associated with said flash illuminating means for projecting a first light image of the first document and the second document onto the charged portion of said photoconductive member to record a first electrostatic latent image of the first document and the second document on said photoconductive member; and means for erasing a portion of the first electrostatic latent image recorded on said photoconductive member corresponding to the first document.

2. A printing machine according to claim 1, wherein said optical means projects a second light image of the first document and the second document onto the charged portion of said photoconductive member to record a second electrostatic latent image of the first document and the second document on said photoconductive member.

3. A printing machine according to claim 2, wherein said erasing means erases the portion of said second electrostatic image recorded on said photoconductive member corresponding to the second document.

4. A printing machine according to claim 3, further including means for developing with developer material the nonerased portion of the first electrostatic latent image to form a first developed image on said photoconductive member and the non-erased portion of the second electrostatic latent image to form a second developed image on said photoconductive member.

5. A printing machine according to claim 4, further including means for transferring the first developed image from said photoconductive member to a first copy sheet surface and the second developed image from said photoconductive member to a second copy sheet surface.

6. A printing machine according to claim 5, wherein the first copy sheet surface and the second copy sheet surface are opposed sides of the same copy sheet.

7. A printing machine according to claim 5 wherein the first copy sheet surface and the second copy sheet surface are on different copy sheets.

* * * * *